United States Patent [19]

Underwood

[11] Patent Number: 4,595,061

[45] Date of Patent: Jun. 17, 1986

[54] DEEP WELL PIPE WATER RELEASE VALVE

[76] Inventor: Thomas L. Underwood, 10 Villa Pkwy., Highland Falls, N.Y. 10928

[21] Appl. No.: 641,308

[22] Filed: Aug. 14, 1984

[51] Int. Cl.[4] ..... E21B 34/06; F04B 39/14

[52] U.S. Cl. ..... 166/373; 166/72; 166/112; 137/570; 417/434

[58] Field of Search ..... 166/68, 72, 105, 112, 166/332, 334, 373, 377, 381, 386, 73; 417/434; 251/145; 137/570

[56] References Cited

U.S. PATENT DOCUMENTS

| | | | |
|---|---|---|---|
| 385,104 | 6/1884 | Diffley | 137/570 |
| 572,959 | 12/1896 | Chapman | 166/68 |
| 1,066,150 | 7/1913 | Reitz | 137/570 |
| 1,402,826 | 1/1922 | Anderson | 137/570 |
| 2,663,261 | 12/1953 | Gage | 417/434 |

*Primary Examiner*—Stephen J. Novosad
*Assistant Examiner*—Bruce M. Kisliuk
*Attorney, Agent, or Firm*—Harvey B. Jacobson

[57] ABSTRACT

A hollow T-shaped fitting is provided including a vertically straight first leg open at its upper and lower ends and a second horizontal lateral leg opening into and outwardly away from an intermediate height portion of the first leg. The outer end of the second leg may be supported from and open laterally into the lower end of a deep well delivery pipe extending upwardly from the deep well pump and a seal defining tubular sleeve valve member is slidingly telescoped in the first leg and spans across the end of the second leg opening into the first leg. The upper end of the sleeve valve member projects above the upper end of the first leg and is equipped with an end cap downwardly abuttingly engageable with the upper end of the first leg. The end cap is centrally apertured and a strong elongated flexible pull member passes downwardly through the cap and the sleeve valve member and has its lower end anchored relative to the pump assembly of the associated well. The pull member includes an abutment thereon at a point spaced upwardly along the pull member from the pump assembly a greater distance than the height of the cap above the pump assembly and the abutment is engageable with the cap to effect upward displacement thereof relative to the first leg upon an upward pull being applied to the pull member.

12 Claims, 4 Drawing Figures

DEEP WELL PIPE WATER RELEASE VALVE

BACKGROUND OF THE INVENTION

When it becomes necessary to repair or replace the pump, motor or delivery pipe of a deep well it is necessary to remove the pump and motor combination as well as the delivery pipe. Normal procedures for effecting this operation involve raising the entire pump, motor and delivery pipe combination through the utilization of a line extending downward into the well and attached to the motor and pump combination. As the entire water pumping assembly of the well is raised the upper sections of the delivery pipe are successively disconnected until the entire delivery pipe string has been disassembled and the motor and pump combination have been lifted from the upper end of the well. If the well uses only a one inch delivery pipe and the well 260 feet deep, the water trapped within the delivery pipe for the well weighs approximately 100 pounds. This weight is of course in addition to the weight of the entire delivery pipe and the motor and pump assembly. Accordingly, it is usually necessary to use a hoist or crane to effect the necessary lifting operation, particularly in view of the fact that the operation is time-consuming in that each individual delivery pipe section must be disconnected from the remainder of the delivery pipe string as it reaches the top of the well. Further, an operation of this type also results in a considerable amount of water being discharged from each pipe section at the top of the well as successive pipe sections are disconnected from the remaining delivery pipe string.

In order to appreciably reduce the weight of the motor, pump and delivery pipe system as it is being raised out of a well bore various structures have been provided for releasing the water standing in the delivery pipe prior to attempting to lift the water pumping assembly from the well. Examples of such previous structures as well as other structures including some of the general operational features of the instant invention are disclosed in U.S. Pat. Nos. 4,362,478, 3,922,115, 3,292,555, 3,011,553, 581,936, 422,535, 374,731 and 300,880. However, most of these previously known devices incorporate unnecessarily complex structures and are not specifically designed to serve the dual function of not only releasing the water standing in a deep well but to also provide a means for lifting the entire pumping assembly from the well.

Accordingly, a need exits for a simplified structure by which the water standing in the delivery pipe of a deep well pump may be drained therefrom and also used as a means for lifting the entire water pumping assembly from the well.

BRIEF DESCRIPTION OF THE INVENTION

The invention includes merely a T-fitting including a first vertical leg and a second horizontal leg opening into and outwardly from the first leg at a point intermediate the upper and lower ends thereof. The outer end of the second leg is adapted to be mounted from the lower end of a deep well water delivery pipe in sealed communication therewith and the first leg includes a cylindrical valve member slidably mounted thereon and bridging the juncture between the first and second legs of the T-fitting. The upper and lower ends of the valve member include O ring seals and the upper end of the valve member projects above the first leg of the T-fitting and has a cap threadedly engaged thereon establishing a limit stop engageable with the upper end of the first leg of the T-fitting to define a lower limit position of movement of the valve member within the first leg. The cap is centrally apertured and a strong rope or cable pull member extends downwardly through the cap, the valve member and outwardly from the lower end of the first leg of the T-fitting and is anchored relative to the motor and pump assembly of the well. In addition, the pull member includes an abutment thereon engageable with the underside of the cap and disposed at a point on the pull member to enable the pull member to be initially pulled upwardly in order to displace the valve member from the upper end of the first leg of the T-fitting and to thereafter become tensioned between the top of the well and the motor and pump assembly for lifting the latter as well as the delivery pipe of the well after the standing water within the delivery pipe has drained from the latter through the second leg of the T-fitting and downwardly outwardly through the lower end of the first leg of the T-fitting.

The main object of this invention is to provide an apparatus by which the water standing within the delivery pipe of a deep well may be drained therefrom prior to lifting the motor and pump assembly as well as the delivery pipe from the well.

Another object of this invention is to provide an apparatus in accordance with the preceding object and including means by which the apparatus also may be used to pull the motor and pump assembly as well as the delivery pipe from the well.

A final object of this invention to be specifically enumerated herein is to provide an apparatus in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE DRAWINGS

DETAILED DESCRIPTION OF THE INVENTION

Figure 1:
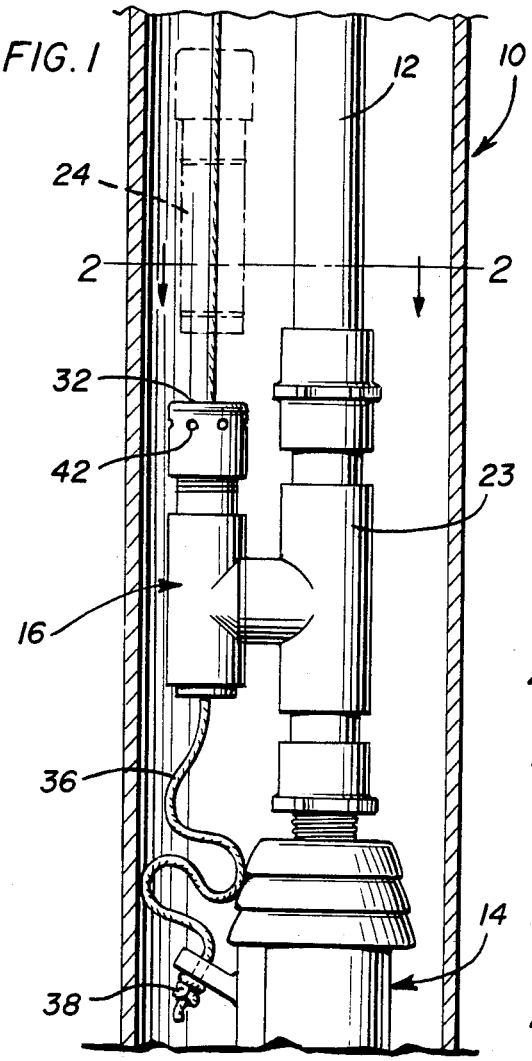
FIG. 1 is a fragmentary vertical section view of the lower end of a deep well pipe casing fragmentarily illustrating the motor and pump assembly and upwardly extending water delivery pipe of the well and with the instant invention operatively associated with both the delivery pipe of the well and the motor and pump assembly thereof.
Figure 2:
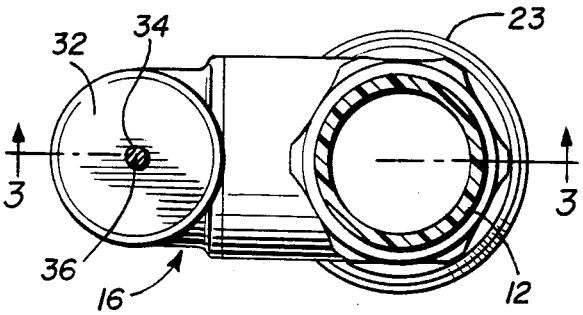
FIG. 2 is an enlarged horizontal section view taken substantially upon the plane indicated by the section line 2—2 of FIG. 1.

Referring now more specifically to the drawings the numeral 10 generally designates a deep well casing downwardly through which a water delivery pipe 12 extends. The lower end portion of the delivery pipe 12 is operably coupled to the upper end portion of a combined motor and deep well pump assembly referred to in general by the reference numeral 14 for receiving water under pressure therefrom.

The release valve of the instant invention is referred to in general by the reference numeral 16 and includes a valve body 18 in the form of a T-fitting including a first tubular vertical leg 20 and a second horizontal tubular leg 22 opening horizontally outwardly from and into the vertical leg 20 at a point spaced intermediate the upper and lower ends thereof, the outer end of leg 22 opening into a T-fitting 23 incorporated in the pipe 12. The valve 16 further includes a tubular valve member 24 slidingly telescoped into and through the vertical leg 20. Upper and lower end portions of the tubular valve member 24 include O ring seals 26 and 28 extending thereabout and the upper end portion of the tubular valve member 24 projects above the upper end of the first vertical leg 20 and is externally threaded as at 30. Further, an internally threaded end cap 32 is removably threaded over the upper end of the tubular valve member 24 above the upper end of the first vertical leg 20.

The end cap 32 is centrally apertured as at 34 and slidingly receives the lower end portion of a strong elongated flexible pull member 36 therethrough. The pull member 36 extends downwardly through the cap, through the tubular member 24 and downwardly from the open lower end of the first leg 20 of the valve body 18. The lower terminal end of the pull member 36 is anchored as at 38 to the assembly 14. Also, the pull member 36 includes an abutment 40 thereon engageable with the underside of the end cap 32.

The position of the abutment 40 on the pull member 36 is such that an upward pull on the pull member 36 from ground level will first upwardly displace the valve member 24 from the upper end of the valve body 18 and thereafter cause that portion of the pull member 36 between the abutment 40 and the assembly 14 to become tensioned. At this point, a further upward pull on the pull member 36 will be capable of effecting upward displacement of not only the assembly 14 but also the delivery pipe 12 through the well casing 10.

Figure 3:
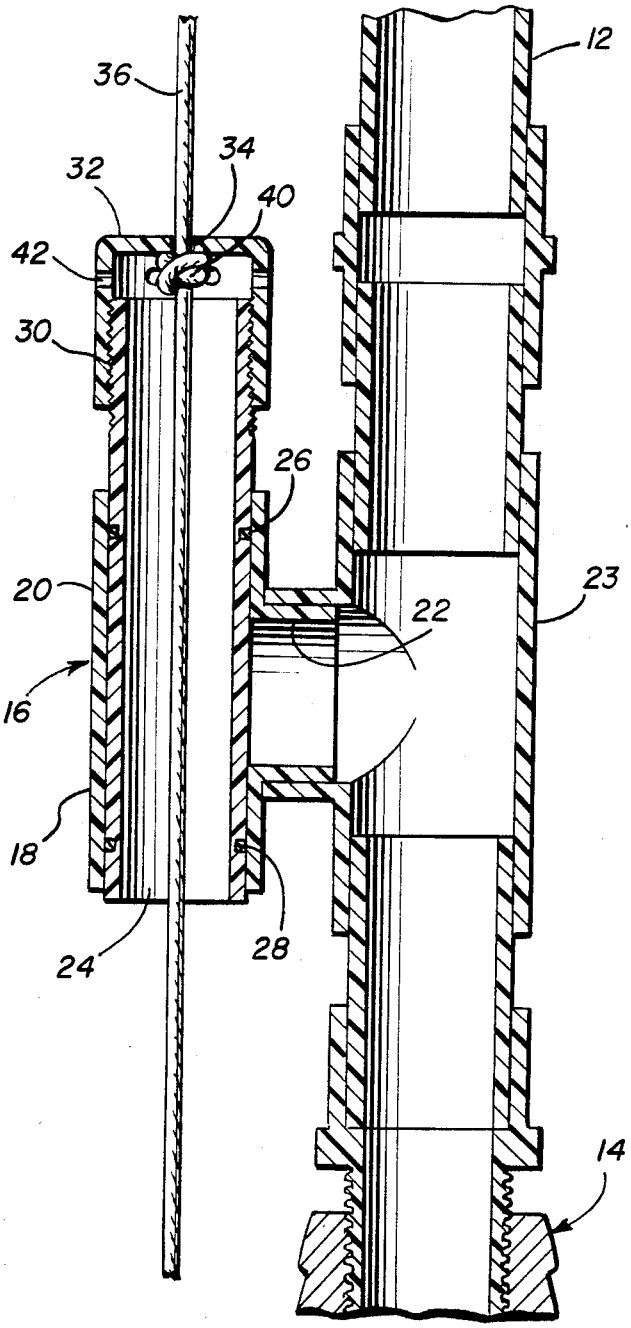
FIG. 3 is a fragmentary vertical sectional view taken substantially upon the plane indicated by the section line 3—3 of FIG. 2.
Figure 4:
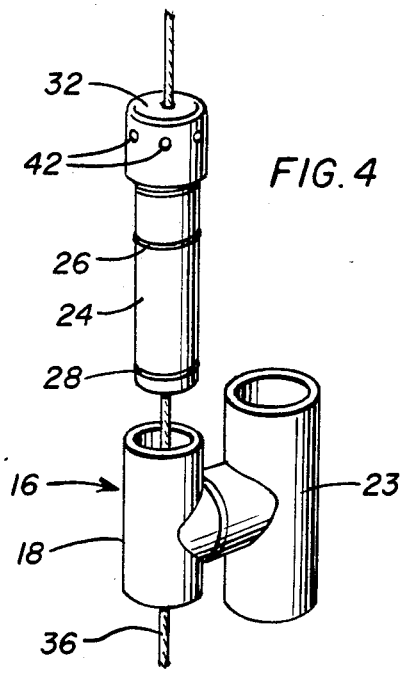
FIG. 4 is an exploded perspective view of the release valve of the instant invention in operative association with a T-fitting to be interposed in the delivery pipe of an associated deep well.

With attention invited more specifically to FIG. 3, the upper O ring seal 26 is spaced above the second horizontal leg 22 a distance greater than the spacing between the upper end of the first vertical leg 20 and the lower end of the cap 32. Accordingly, the cap 32 defines a lower limit of movement of the tubular valve member 24 with the O ring 26 still spaced above the second horizontal leg 22. Further, it is important that the abutment 40 be spaced sufficiently above the point at which the pull member 36 is anchored to the assembly 14 as at 38 to enable pull member 36 to completely upwardly displace the tubular valve member 24 from the vertical leg 20 before the lower end of the pull member 36 below the abutment becomes tensioned. In this manner, the lower end of the tubular member 24 will not be telescoped within the vertical leg 20 as a stronger pull is applied to the pull member 36 in order to lift the assembly 14, which stronger pull could result in the assembly 14 being slightly cocked and damage to either the tubular valve member 24 or the upper end of the vertical leg 20 being incurred.

It will further be noted that the cap 32 includes radial ports 42 formed therein. This is to prevent the tubular member 24 and cap 32 from trapping air therein in the event the central aperture in the end wall 32 becomes clogged with such trapped air possibly rendering the tubular member 24 sufficiently buoyant in the event of a rise in water level within the casing 10 to cause the tubular valve 24 to be upwardly displaced from the upper end of the vertical leg 20.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A deep well pipe water release valve including a valve assembly comprising a body defining an upright passage therethrough having upper and lower ends, said body including a lateral port having an inner end opening into said passage intermediate said upper and lower ends ans an outer end adapted for sealed communication with the interior of the lower end portion of a deep well delivery pipe disposed in a deep well, a valve member slidably received in said passage and upwardly displaceable from the latter, said valve member being shiftable in said passage to a position spanning across said port, seal means establishing a sliding fluidtight seal between said valve member and said body both above and below said port, and vertical pull means including a lower end terminal portion adapted for anchored securement to a motor and pump assembly within said deep well below said body and an intermediate height lower end portion above said lower terminal end portion operably connected to said valve member for upward displacement of the latter from the upper end of said passage upon an upward pull on the upper end portion of said pull member and with the operable connection of said pull member with said valve member being sufficiently spaced above said lower terminal end of said pull member to enable upward displacement of said valve member from the upper end of said passage before a continued upward pull on said pull member is effective to apply an upward pull on said motor and pump assembly.

2. The release valve of claim 1 wherein said body comprises a hollow T-shaped tubular member including a first vertical leg having upper and lower ends and defining said passage and a second horizontal leg opening outwardly from and into said first leg intermediate the upper and lower ends thereof, said second leg defining said port.

3. The release valve assembly of claim 2 wherein said valve member comprises a subular member lengthwise disposed in said passage and having upper and lower end portions with the upper end portion of said tubular member projecting above the upper end of said first leg, the upper end portion of said tubular member including a centrally apertured end cap downwardly through which said pull means extends, said cap being downwardly abuttingly engageable with the upper end of said first leg to define a lower limit position of movement of said tubular member in said passage.

4. The release valve of claim 3 wherein said pull member comprises an elongated flexible tension member slidably received through said end cap and includes an abutment thereon below said end cap upwardly abuttingly engageable with the latter establishing a one-way connection between said pull member and said cap.

5. The release valve of claim 4 wherein said cap includes cylindrical wall portions disposed above the upper end of said tubular member having at least one radial vent port formed therein.

6. The release valve of claim 2 wherein said seal means comprises O rings carried by said tubular member above and below said port.

7. In combination with a deep well of the type including a deep well motor and pump assembly mounted in a lower portion of said well and including an upstanding delivery pipe having upper and lower end portions and projecting upwardly from said assembly to generally ground level, a valve body mounted on said lower end portion of said pipe above said motor and pump assembly and defining a substantially vertical passage therethrough having upper and lower ends, passage means communicating the interior of said delivery pipe with the interior of an intermediate portion of said vertical passage, a valve member slidably disposed in said vertical passage and upwardly removable from the upper end thereof, said valve member including seal means establishing a fluidtight seals between said valve member and said vertical passage at points spaced spaced therealong above and below said intermediate portion of said passage, elongate upstanding pull means including a lower end portion anchored relative to said assembly and an intermediate lower portion spaced above said pull means lower end portion operably engaged with said valve member, said pull means extending upwardly to a point adjacent the upper end of said well and being upwardly displaceable to successively upwardly displace said valve member from said passage and thereafter upwardly displace said motor and pump assembly within said well.

8. The combination of claim 7 wherein said valve member comprises an upstanding tubular member having upper and lower ends and said pull means extends downwardly through said tubular member and said passage.

9. The combination of claim 8 wherein the upper end of said tubular member projects above the upper end of said passage and includes an upper end cap, said upper end cap being centrally apertured, said pull means extending downwardly through said apertured cap.

10. The assembly of claim 7 wherein said pull means includes an elongated flexible tension member including a lost motion connection with said valve member and a fixed connection with said motor and pump assembly.

11. The assembly of claim 7 wherein said seal means comprises O-rings carried by said valve member above and below said intermediate portion of said vertical passage.

12. The method of adapting a deep well pumping system for ease in upward retrieval of the pumping system from an associated well wherein the pumping system includes a deep well motor and pump assembly and a delivery pipe extending upwardly from said assembly at least substantially to ground level, said method comprising establishing a vertical passage closely adjacent the lower end portion of said delivery pipe above said assembly with an intermediate length portion of said passage in communication with the interior of said delivery pipe, providing a valve member slidably received within said passage, upwardly displaceable from the upper end of said passage and including spaced seal means establishing sliding fluid tight seals between said valve member and said passage above and below said intermediate length portion of said passage, providing an elongated flexible pull member having a lower end anchored relative to said assembly and a second lower portion thereof spaced above said lower end including a connection with said valve member such that an upward pull on the upper end of said pull member will first upwardly displace said valve member from said passage and thereafter upwardly displace said assembly and delivery pipe.

* * * * *